US007556531B2

(12) United States Patent
Takeuuchi et al.

(10) Patent No.: US 7,556,531 B2
(45) Date of Patent: Jul. 7, 2009

(54) CONNECTOR

(75) Inventors: Yousuke Takeuuchi, Tokyo (JP); Hironobu Ando, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/076,583

(22) Filed: Mar. 20, 2008

(65) Prior Publication Data

US 2008/0242142 A1 Oct. 2, 2008

(30) Foreign Application Priority Data

Mar. 28, 2007 (JP) ..... 2007-084652

(51) Int. Cl.
*H01R 13/648* (2006.01)

(52) U.S. Cl. ..... 439/607

(58) Field of Classification Search ..... 439/607
See application file for complete search history.

(56) References Cited

U.S. PATENT DOCUMENTS

2007/0149055 A1 * 6/2007 Watanabe et al. ..... 439/607
2007/0167076 A1 * 7/2007 Seh et al. ..... 439/607
2007/0173119 A1 * 7/2007 Xiao et al. ..... 439/607
2008/0207052 A1 * 8/2008 Zhang ..... 439/607

FOREIGN PATENT DOCUMENTS

JP 07-220814 8/1995

* cited by examiner

*Primary Examiner*—Tho D Ta
(74) *Attorney, Agent, or Firm*—Kubotera & Associates, LLC

(57) ABSTRACT

A connector includes a shell, a housing, and a plurality of terminals. The shell with a tubular shape has a first opening and a second opening. The housing includes a housing body portion, a holding portion, and a protruding portion. The housing body portion covers the second opening. The holding portion extends from the housing body portion to the first opening and holds the terminals. The protruding portion extends from a rear side of the housing body portion to the second opening side. The shell has first and second tongue portions that extend in a direction perpendicular to a fitting direction of a mating connector. Each of the first and second tongue portions is caulked in the protruding portion from an upper side and a lower side to cover the protruding portion. The second tongue portion has a board connection portion to be connected to a board.

6 Claims, 9 Drawing Sheets

CONNECTOR

BACKGROUND OF THE INVENTION

The present invention relates to a connector. Specifically, the present invention relates to a connector having a metal cover in an outer circumference of an insulation housing.

A connector in which a metal cover is provided in an outer circumference of an insulation housing is widely used in a personal computer, a cellular phone, and other electronic devices. Such a metal cover can provide a shielding function as well as a protection function. As a conventional connector of this type, for example, there is a connector disclosed in Japanese Patent Publication No. 07-220814. FIG. 10 is a plan view showing the conventional connector. FIG. 11 is a bottom view showing the conventional connector. FIG. 12 is a rear view showing the conventional connector.

Patent Reference: Japanese Patent Publication No. 07-220814

A connector 100 comprises mainly an insulation housing 121, a metal cover 110, and a contact 130. The metal cover 110 covers a part of the insulation housing 121. The contact 130 is fixed to the insulation housing 121. As shown in FIG. 12, a fine strip 115 of the metal cover 110 is bent into a recess portion 124 of the insulation housing 121 to pressure downwardly. Accordingly, the metal cover 110 is fixed to the insulation housing 121. The connector 100 that is assembled is fixed through terminals for attachment 112 to a board with solder while an attachment surface 11 faces the board.

In the conventional connector, a width "K" of the fine strip 115 in a fitting direction "E" of a mating connector is sized to be smaller than a width "L" of the recess portion 124 in the direction. Accordingly, after the fine strip 115 is bent into the recess portion 124, a space "M" is created between the fine strip 115 and the recess portion 124. The space "M" causes a backlash between the insulation housing 121 and the metal cover 110. Further, the backlash causes a solder crack in a solder fixed portion of the board and the metal cover 110. Accordingly, when the insulation housing 121 receives an excessive external force such as a twisting force, the insulation housing 121 can come off from the metal cover 110. Further, in the configuration, a specific height "N" has to be provided in the metal cover 110 to bend the fine strip 115. As a result, the connector is enlarged. Further, there is such a problem that a fixing force against the board is weak.

In view of the problems described above, an objective of the present invention is to provide a connector in which a metal cover is securely caulked to an insulation housing to increase a fixing force between the metal cover and the insulation housing. A further objective of the present invention is to provide a connector that is small and can be more securely fixed to a board.

Further objects of the invention will be apparent from the following description of the invention.

SUMMARY OF THE INVENTION

In order to attain the objects described above, according to the present invention, a connector includes a shell, a housing, and a plurality of terminals. The shell with a tubular shape has a first opening portion and a second opening portion. The housing is arranged inside of the shell. The terminals are held with the housing. Further, the connector is electrically connected with a mating connector that is inserted into the connector through the first opening portion.

The housing includes a housing main body, a holding portion, and a protruding portion. The housing main body covers the second opening portion of the shell. The holding portion extends from the housing main body toward the first opening portion and holds the plurality of the terminals. The protruding portion extends from a rear side of the housing main body toward the second opening portion.

The shell has first and second tongue portions that extend in a direction perpendicular to a fitting direction of the mating connector. Each of the first and second tongue portions is caulked in the protruding portion from an upper side and a lower side to cover the protruding portion. The second tongue portion has a board connection portion that is connected to a board.

In the connector of the present invention, a width of the second tongue portion in the fitting direction may be larger than that of the first tongue portion.

In the connector of the present invention, the shell may have an inward protruding portion that protrudes from the upper face to inside thereof. The housing can be held between the inward protruding portion and the first tongue portion.

In the connector of the present invention, a taper may be provided in a portion of the insulation housing in which the first and second tongue portions are caulked.

In the connector of the present invention, the inward protruding portion may extend in a direction perpendicular to the fitting direction of the mating connector. The housing can be held between a fracture or sectional plane of the inward protruding portion and a fracture or sectional plane of the first tongue portion.

In the connector of the present invention, the inward protruding portion of the shell may have an abutted portion which a distal portion of the mating connector abuts against on the first opening side.

In the present invention, the connector with a small size has the metal cover that can be more securely caulked to the insulation housing, and the metal cover can be used for mounting the connector on the board.

BRIEF DESCRIPTION OF THE DRAWINGS

FIG. 2(*b*) is a plan view of the connector; FIG. 2(*c*) is a front view of the connector; FIG. 2(*d*) is a bottom view of the connector; and FIG. 2(*e*) is a rear view of the connector;

FIG. 5(*b*) is a plan view of the shell; FIG. 5(*c*) is a front view of the shell; FIG. 5(*d*) is a bottom view of the shell; and FIG. 5(*e*) is a rear view of the shell;

FIG. 7(*b*) is a plan view of the insulation housing; FIG. 7(*c*) is a front view of the insulation housing; FIG. 7(*d*) is a bottom view of the insulation housing; and FIG. 7(*e*) is a rear view of the insulation housing;

DESCRIPTION OF THE PREFERRED EMBODIMENTS

Hereunder, embodiments of the present invention will be explained with reference to the accompanying drawings.

In the embodiment, an electrical connector of a so-called receptacle side will be explained as an example. The present invention is not limited to the electrical connector of this type, and can be applied to various types of electrical connectors.

Figure 1:
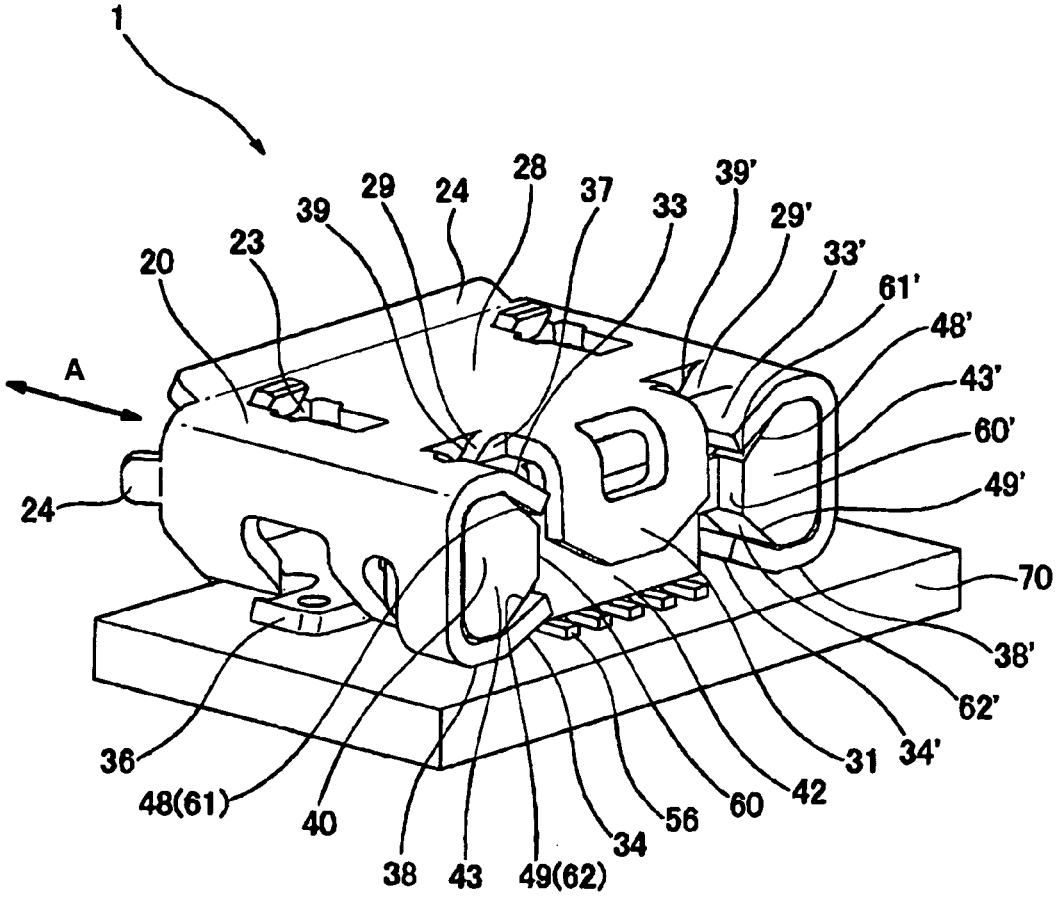
FIG. 1 is a rear perspective view showing a connector according to an embodiment of the present invention.
Figure 2:
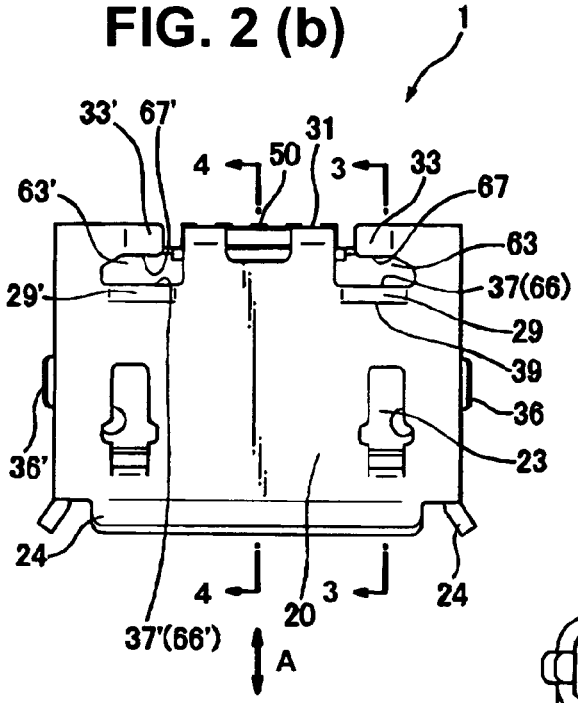
FIGS. 2(*a*) to 2(*e*) are views showing the connector according to an embodiment of the present invention, wherein FIG. 2(*a*) is a side view of the connector.
Figure 2:
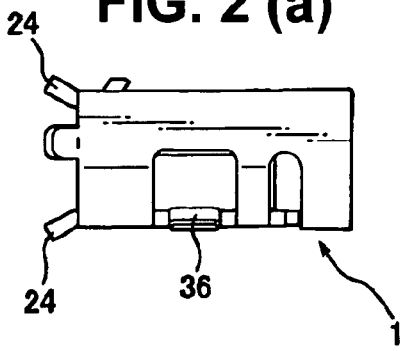
Figure 2:
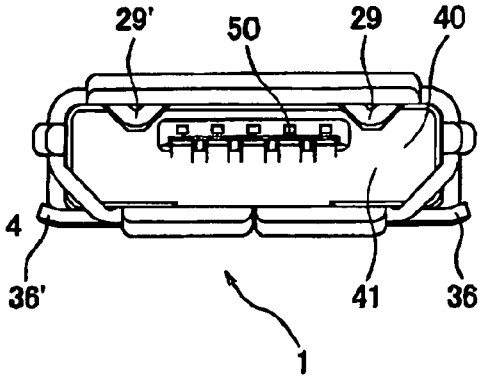
Figure 2:
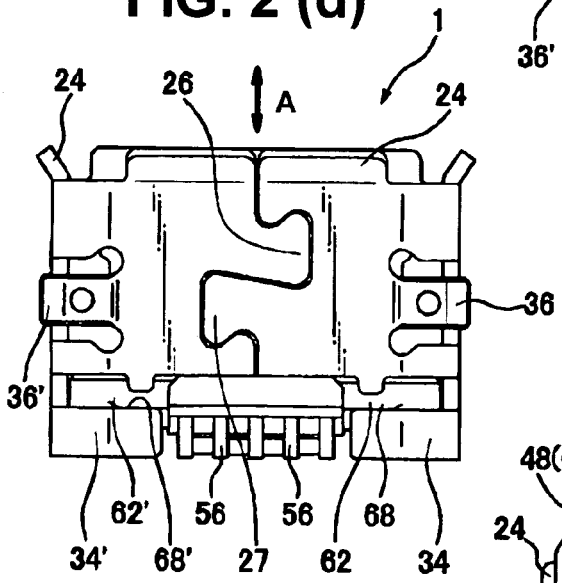
Figure 2:
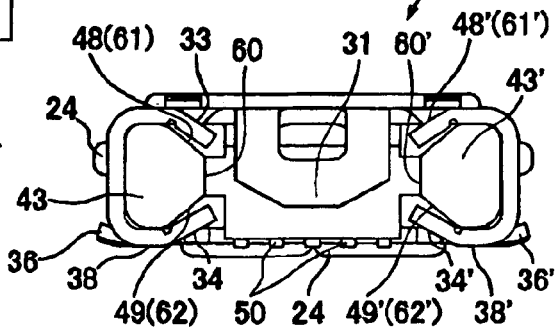
Figure 3:
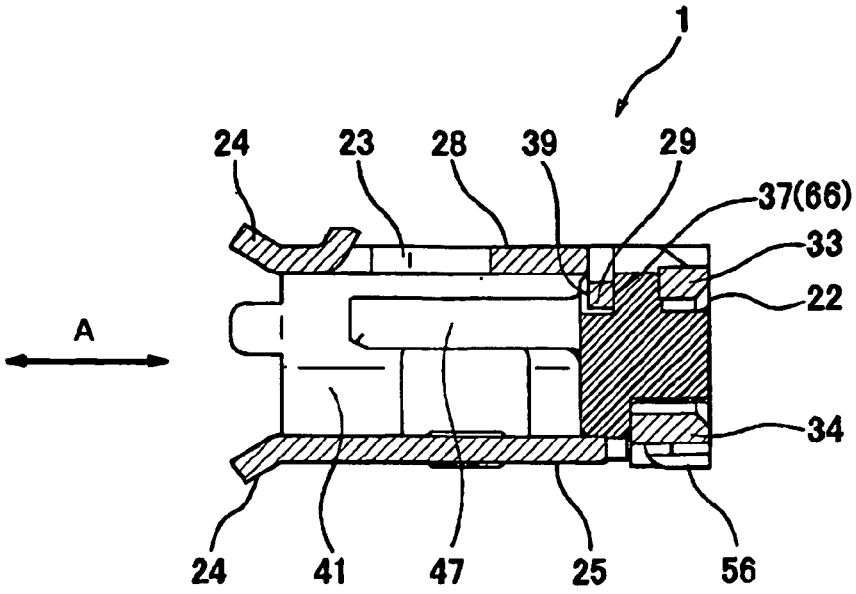
FIG. 3 is a sectional view of the connector taken along a line 3-3 in FIG. 2(*b*)
Figure 4:
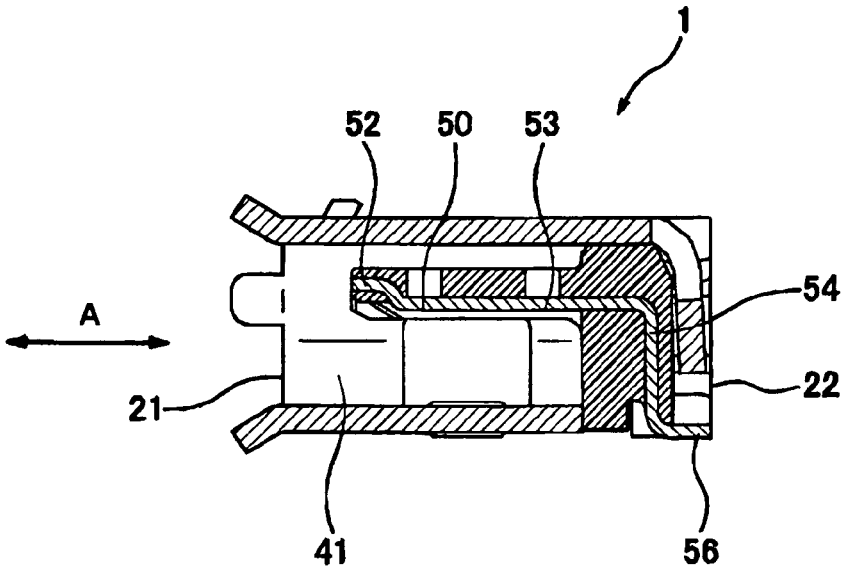
FIG. 4 is a sectional view of the connector taken along a line 4-4 in FIG. 2(*b*).

FIG. 1 is a rear perspective view showing a connector 1 according to an embodiment of the present invention. FIGS. 2(*a*) to 2(*e*) are views showing the connector 1. More specifically, FIG. 2(*a*) is a side view of the connector 1; FIG. 2(*b*) is a plan view of the connector 1; FIG. 2(*c*) is a front view of the connector 1; FIG. 2(*d*) is a bottom view of the connector 1; and FIG. 2(*e*) is a rear view of the connector 1. FIG. 3 is a sectional view of the connector 1 taken along a line 3-3 in FIG. 2(*b*). FIG. 4 is a sectional view of the connector 1 taken along a line 4-4 in FIG. 2(*b*).

In the embodiment, the connector 1 has a symmetrical shape relative to a centerline (the line 4-4 in FIG. 2(*b*)) extending in a fitting direction (direction indicated by an arrow A) with a mating connector (not shown). Further, the connector 1 has at least a shell 20, an insulation housing 40, and a plurality of terminals 50. The insulation housing 40 formed of a resin or the like is provided inside of the shell 20. The shell 20 covers outside of the insulation housing 40. The terminals 50 are arranged with a narrow interval in parallel with each other inside the insulation housing 40.

The terminals 50 are integrally fixed to the insulation housing 40 in a normal manner. As shown in FIG. 4, the terminal 50 is fixed to the insulation housing 40 at a distal fixed portion 52 and a rear fixed portion 54 thereof. A lower side of a contact piece 53 at a middle portion of the terminal 50 is exposed in a space 41.

The space 41 is provided from a front portion to a rear portion of the insulation housing 40 to insert and remove the mating connector. A solder portion 56 provided in a rear edge portion of the terminal 50 can be used for connecting or fixing the connector 1 to a board 70.

When the connector 1 is used, the connector 1 is attached to, for example, the board 70, as shown in FIG. 1. The mating connector that is connected to the connector 1 is inserted into and removed from the connector 1 in a freely attachable and detachable manner through a first opening portion 21. The first opening portion 21 is provided in a back surface side of the connector 1.

When the mating connector is inserted into the connector 1 through the first opening portion 21, the connector 1 can be electrically connected to specific portions of corresponding terminals of the mating connector near the contact pieces 53 of the terminals 50 provided in the connector 1. Further, at this time, the connector 1 can be locked with the mating connector through fitting of fitting holes 23 of the connector 1 and locking pieces of the mating connector.

Figure 5:
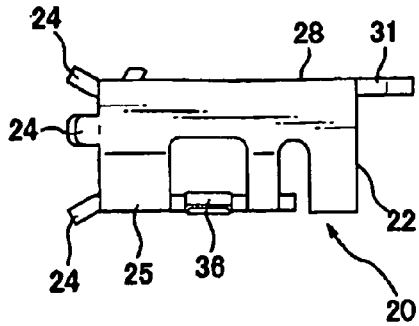
FIGS. 5(*a*) to 5(*e*) are views showing a shell of the connector corresponding to FIGS. 2(*a*) to 2(*e*) according to the embodiment of the present invention, wherein FIG. 5(*a*) is a side view of the shell.
Figure 5:
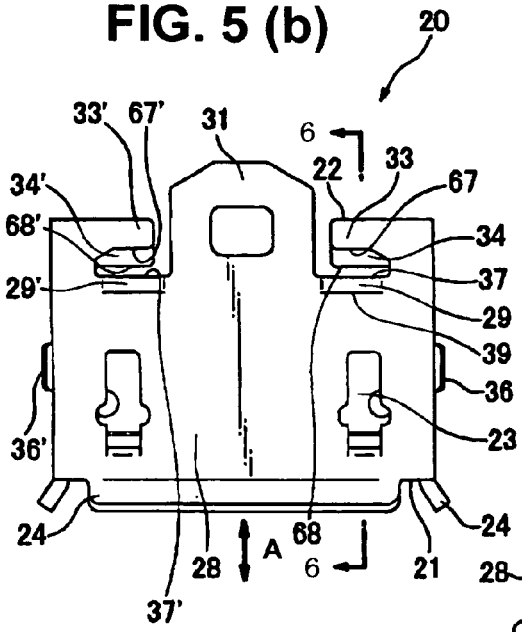
Figure 5:
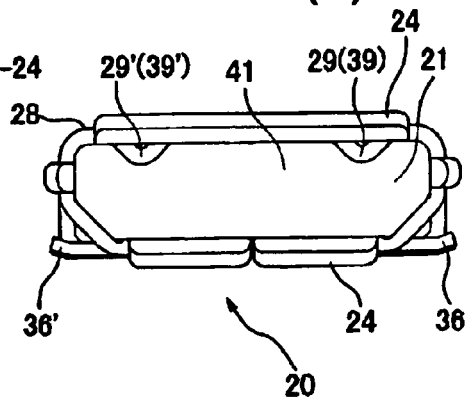
Figure 5:
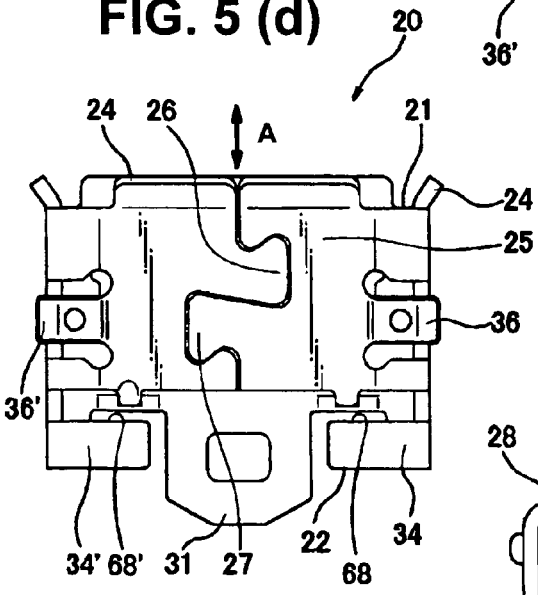
Figure 5:
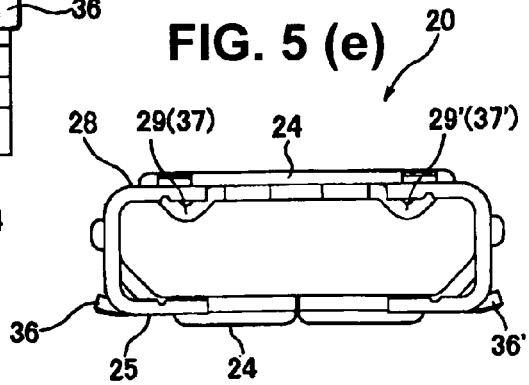
Figure 6:
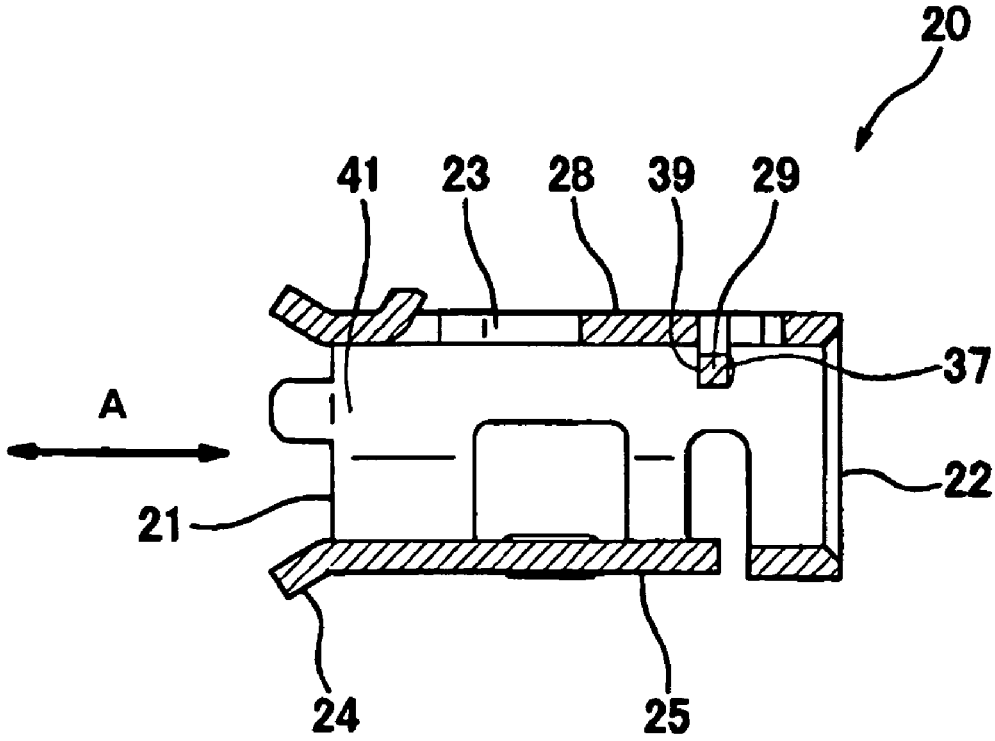
FIG. 6 is a sectional view of the shell corresponding to FIG. 3 and taken along a line 6-6 in FIG. 5(*b*)
Figure 7B:
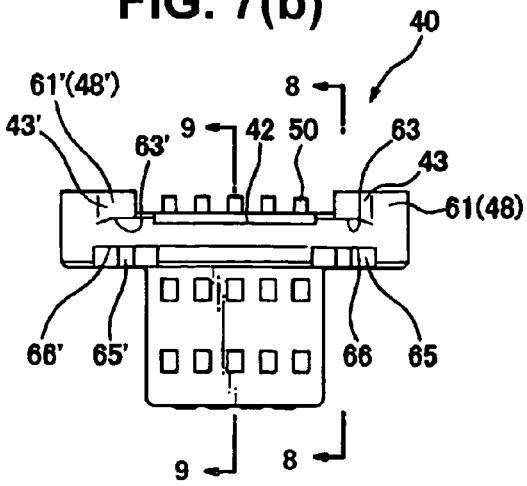
FIGS. 7(*a*) to 7(*e*) are views showing an insulation housing of the connector corresponding to FIGS. 2(*a*) to 2(*e*) according to the embodiment of the present invention, wherein FIG. 7(*a*) is a side view of the insulation housing.
Figure 7A:
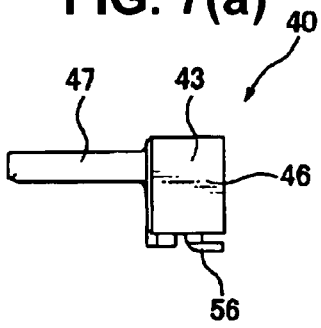
Figure 7C:
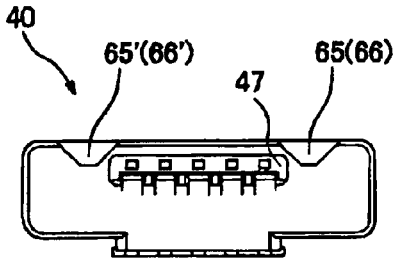
Figure 7D:
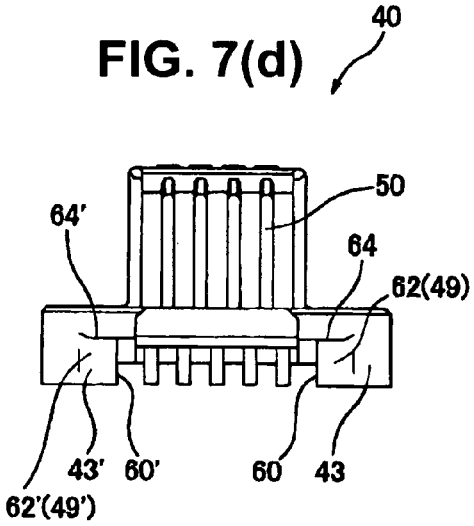
Figure 7E:
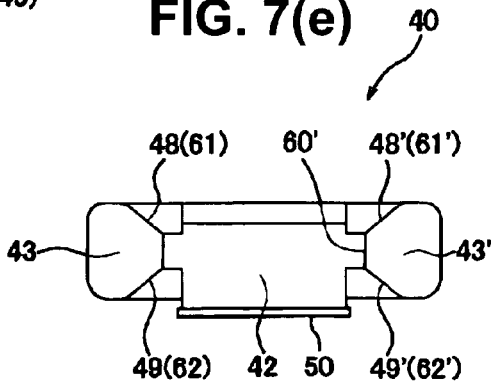

FIGS. 5(*a*) to 5(*e*) are views showing the shell 20 corresponding to FIGS. 2(*a*) to 2(*e*) according to the embodiment of the present invention. More specifically, FIG. 5(*a*) is a side view of the shell 20; FIG. 5(*b*) is a plan view of the shell 20; FIG. 5(*c*) is a front view of the shell 20; FIG. 5(*d*) is a bottom view of the shell 20; and FIG. 5(*e*) is a rear view of the shell 20. FIG. 6 is a sectional view of the shell 20 corresponding to FIG. 3 and taken along a line 6-6 in FIG. 5(*b*).

FIGS. 5(*a*) to 5(*e*) specifically show a state before the insulation housing 40 is inserted into the shell 20. Accordingly, FIGS. 5(*a*), 5(*b*), 5(*d*), and 5(*e*) are somewhat different from FIGS. 1 to 4 that show a state after the insulation housing 40 is completely inserted into the shell 20.

In the embodiment, the shell 20 is made through punching and bending a thin metal plate in a cylinder shape. Protruding portions 26 and 27 (shown in FIG. 5(*d*)) having complementary shapes are provided in a bottom plate portion 25 to mesh with each other in order to maintain the cylinder shape. The shell 20 has a cylinder shape, so that the first opening portion 21 and a second opening portion 22 are positioned to face each other. The first opening portion 21 is used as an insertion slot to insert or remove the mating connector.

In the embodiment, a guide portion 24 is provided nearby to guide the mating connector to be inserted with ease. The guide portion 24 opens on the insertion side of the mating connector. The second opening portion 22 is used to insert the insulation housing 40 into the shell 20. A rear side 42 of the insulation housing 40 substantially closes the second opening portion 22 after the insulation housing 40 is inserted.

In the embodiment, a cover wall 31 is provided in the shell 20. The cover wall 31 covers near a center portion of the rear side 42 of the insulation housing 40 provided in the shell 20. The cover wall 31 extends outwardly along a fitting direction of the mating connector in an upper plate portion 28 of the shell 20. After the insulation housing 40 is inserted into the shell 20, the cover wall 31 having a hole at a center thereof is vertically bent toward the second opening portion 22. Accordingly, the insulation housing 40 is prevented from coming off through the second opening portion 22. Further, the terminal 50 can be electrically shielded. FIGS. 5(*a*) to 5(*e*) show a state before the cover wall 31 is bent, while FIGS. 1 to 4 show a state after the cover wall 31 is bent.

In the embodiment, inward protruding portions 29 and 29' are provided so that the shell 20 can hold the insulation housing 40 tightly. The inward protruding portions 29 and 29' protrude inwardly from the upper face of the shell 20. The inward protruding portions 29 and 29' are arranged so that the inward protruding portions 29 and 29' are situated on right and left sides in the rear of the upper plate portion 28 of the shell 20. Each of the inward protruding portions 29 and 29' has a distal end in the center side thereof.

The inward protruding portions 29 and 29' are provided to extend in a direction perpendicular to a fitting direction of the mating connector. More specifically, specific portions of the upper plate portion 28 are cut in vertically long transverse U-shapes. Further, near the center portion of each cut portion is folded in a valley shape toward inside of the shell 20 to form an approximate triangle shape along the fitting direction of the mating connector.

The insulation housing 40 that is inserted into the shell 20 through the second opening portion 22 can contact with contact surfaces 37 and 37' on the second opening sides of the inward protruding portions 29 and 29' in corresponding portions (abutment surfaces 66 and 66'), respectively. As a result, a movement of the insulation housing 40 toward the first opening portion 21 inside of the shell 20 is regulated. Further, a movement of the insulation housing 40 toward the second opening portion 22 is also regulated in the method described later. Accordingly, the shell 20 can hold the insulation housing 40 more securely.

In the embodiment, the first opening portion 21 of the inward protruding portions 29 and 29' can be used to prevent the mating connector from being inserted to a large extent. For example, the movement of the mating connector that is inserted through the first opening portion 21 can be regulated through contacting with abutted portions 39 and 39' on a side of the first opening portion 21 of the inward protruding portions 29 and 29' in the distal portions of the mating connector, respectively.

Accordingly, it is prevented that an excessive force is applied against the insulation housing 40. For example, even though an excessive external force is applied through a twisting force of the mating connector or the like, a coming off of the insulation housing 40 from the shell 20 can be minimized.

In the embodiment, first tongue portions 33 and 33' and second tongue portions 34 and 34' are provided so that the shell 20 can hold the insulation housing 40 more securely through regulating a movement of the insulation housing 40 toward the second opening portion 22 inside of the shell 20. A part of the upper plate portion 28 of the shell 20 is cut in a tongue portion shape at a specific position on right and left rear sides of the upper plate portion 28 of the shell 20. Accordingly, the first tongue portions 33 and 33' extend in a direction perpendicular to a fitting direction of the mating connector.

Further, distal portions of the first tongue portions 33 and 33' face toward the center of the upper plate portion 28. Similarly, a part of the bottom plate portion 25 of the shell 20 is cut in a tongue portion shape at a specific position on right and left rear sides of the bottom plate portion 25 of the shell 20. Accordingly, the second tongue portions 34 and 34' extend in a direction perpendicular to a fitting direction of the mating connector.

Further, distal portions of the second tongue portions 34 and 34' face toward the center of the bottom plate portion 25. Accordingly, a gap between the first tongue portion 33 and the second tongue portion 34, or a gap between the first tongue portion 33' and the second tongue portion 34' is created.

Further, the gap between the first tongue portion 33 and the second tongue portion 34 or a gap between the first tongue portion 33' and the second tongue portion 34' creates a space in which specific portions of the insulation housing 40 (protruding portions 43 and 43') are provided on right and left sides of the shell 20 in a top-to-bottom direction.

In the embodiment, the tongue portions 33 and 33' and 34 and 34' are bit into the insulation housing 40 to caulk. Accordingly, the insulation housing 40 can be fixed to a specific position of the shell 20.

More specifically, as shown in FIG. 3, the first tongue portions 33 and 33' along with the inward protruding portions 29 and 29', respectively, are caulked at specific positions of the insulation housing 40 while holding a part of the insulation housing 40. Accordingly, the insulation housing 40 is securely fixed to the shell 20.

The rear sides of the first tongue portions 33 and 33' and the second tongue portions 34 and 34' extend to approximately the same position in a fitting direction of the mating connector. Widths of the second tongue portions 34 and 34' are larger than that of the first tongue portion 33 and 33', respectively, in the direction. Accordingly, the front sides of the first tongue portions 33 and 33' and the second tongue portions 34 and 34' are displaced with each other to some extent.

Figure 8:
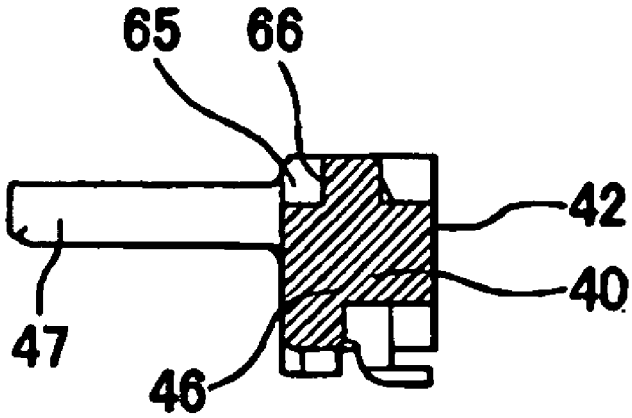
FIG. 8 is a sectional view of the insulation housing corresponding to FIG. 3 and taken along a line 8-8 in FIG. 7(*b*)
Figure 9:
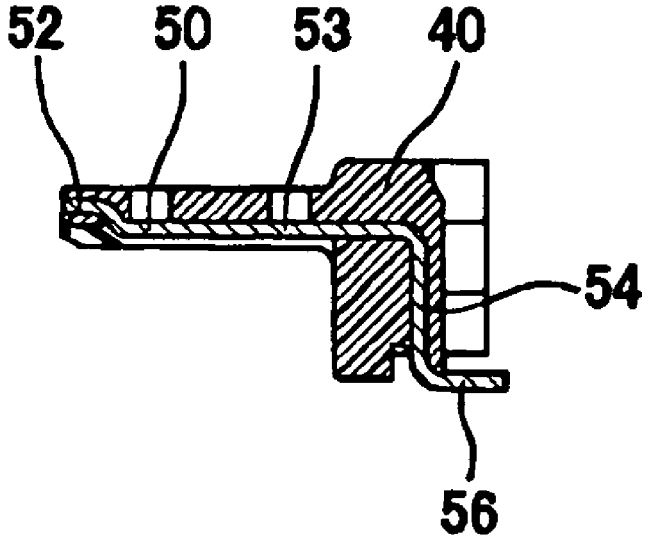
FIG. 9 is a sectional view of the insulation housing corresponding to FIG. 4 and taken along a line 9-9 in FIG. 7(*b*)

FIGS. 7(*a*) to 7(*e*) are views showing the insulation housing 40 of the connector 1 corresponding to FIGS. 2(*a*) to 2(*e*) according to the embodiment of the present invention. More specifically, FIG. 7(*a*) is a side view of the insulation housing 40; FIG. 7(*b*) is a plan view of the insulation housing 40; FIG. 7(*c*) is a front view of the insulation housing 40; FIG. 7(*d*) is a bottom view of the insulation housing 40; and FIG. 7(*e*) is a rear view of the insulation housing 40. FIG. 8 is a sectional view of the insulation housing 40 taken along a line 8-8 in FIG. 7(*b*) and corresponding to FIG. 3. FIG. 9 is a sectional view of the insulation housing 40 taken along a line 9-9 in FIG. 7(*b*) and corresponding to FIG. 4.

In the embodiment, the insulation housing 40 has a main body portion 46, a holding portion 47, protruding portions 43 and 43', and grooved recess portions 65 and 65'. The main body portion 46 forms the rear side 42 that covers the second opening portion 22 of shell 20. The holding portion 47 holds a plurality of the terminals 50 that extends in plate shapes from the main body portion 46 toward the first opening portion 21 in parallel.

The protruding portions 43 and 43' extend from right and left sides of the rear side 42 of the main body portion 46 toward the second opening portion 22. The grooved recess portions 65 and 65' are formed in triangle shapes near the first opening portion 21 of the main body portion 46 to correspond to the inward protruding portions 29 and 29' of the shell 20, respectively. The protruding portions 43 and 43' protrude to a rear side only in a horizontal direction, and do not protrude to a height direction of the insulation housing 40.

Further, each of the protruding portions 43 and 43' has a section having an approximate isosceles triangle shape rotated 90 degrees so that peak portions 60 and 60' face toward a center line (the line 4-4 in FIG. 2(*b*)) of the insulation housing 40 on right and left sides of the insulation housing 40.

In the embodiment, upper flat surfaces 61 and 61' form upper sides 48 and 48' that extend obliquely upward from the peak portions 60 and 60' of the triangle sections, respectively. The upper flat surfaces 61 and 61' and the main body portion 46 of the insulation housing 40 are connected through a continuous area. A part of the body portion side is inclined so that the upper flat surfaces 61 and 61' and the main body portion 46 are continued. Accordingly, upper tapers 63 and 63' that are flat are formed in the continuous area.

Similarly, lower sides 49 and 49' extend obliquely downward from the peak portions 60 and 60' of the triangle sections. Lower flat surfaces 62 and 62' form lower sides 49 and 49', respectively. Further, the lower flat surfaces 62 and 62' and the main body portion 46 of the insulation housing 40 are connected through a continuous area. A part of the main body portion 46 is inclined so that the lower flat surfaces 62 and 62' and the main body portion 46 are continued. Accordingly, lower tapers 64 and 64' are formed in the continuous area.

As described later, the upper tapers 63 and 63' and the lower tapers 64 and 64' play an important role when the first tongue portions 33 and 33' and the second tongue portions 34 and 34' are caulked, respectively.

When the insulation housing 40 is installed in the shell 20, the inward protruding portions 29 and 29' of the shell 20 fit into the grooved recess portions 65 and 65' of the insulation housing 40 (shown in FIGS. 2(*c*), 6, and 8), respectively. The contact surfaces 37 and 37' of the inward protruding portions 29 and 29' abut against the abutment surfaces 66 and 66' of the insulation housing 40, respectively.

As a result, the insulation housing 40 is positioned inside of the shell 20 in a front direction. At this time, the first tongue portions 33 and 33' and the second tongue portions 34 and 34' of the shell 20 are arranged on circumference surfaces of the protruding portions 43 and 43', respectively. Specifically, the first tongue portions 33 and 33' and the second tongue portions 34 and 34' of the shell 20 are arranged along a portion except the upper sides 48 and 48', respectively (the upper flat surfaces 61 and 61' that extend from the upper sides 48 and 48', respectively) and the lower sides 49 and 49', respectively (the lower flat surfaces 62 and 62' that extend from the lower sides 49 and 49', respectively).

In this arrangement, the first tongue portions 33 and 33' and the second tongue portions 34 and 34' are caulked contrastingly from an upper side and lower sides to an upper sides 48 and 48' and the lower sides 49 and 49' of the protruding portions 43 and 43' toward the peak portions 60 and 60' to surround the protruding portions 43 and 43' in the protruding portions 43 and 43' on right and left sides of the insulation housing 40, respectively. Accordingly, the insulation housing 40 is more securely fixed to the shell 20. FIG. 5(*b*) shows a state before the caulking, while FIGS. 2(*b*) and 1 show a state after the caulking.

When the first tongue portions 33 and 33' and the second tongue portions 34 and 34' are caulked to the protruding portions 43 and 43', the first tongue portions 33 and 33' and the second tongue portions 34 and 34' press to crush (or scrape) a part of the insulation housing 40 near side surface edge portions 67 and 67', and 68 and 68' (shown in FIG. 5(*b*) etc.), respectively.

Further, the first tongue portions 33 and 33' and the second tongue portions 34 and 34' are caulked in a state in which the insulation housing 40 is positioned to be slightly pressed to the first opening portion 21 side. As a result, the first tongue portions 33 and 33' and the second tongue portions 34 and 34' are specifically fixed to the insulation housing 40 in the side surface portions.

Further, the first tongue portions 33 and 33' and the second tongue portions 34 and 34' are fixed there so that a part of the first tongue portions 33 and 33' and the second tongue portions 34 and 34' is buried in the insulation housing 40, respectively.

At this time, as shown in FIG. 3, the insulation hosing 40 is held on the upper side thereof between the inward protruding portions 29 and 29' and the first tongue portions 33 and 33' of the shell 20, respectively. Accordingly, the shell 20 can be more securely fixed to the insulation housing 40.

In the embodiment, the tapers 63 and 63' and 64 and 64' are provided to correspond to an installation direction of the first tongue portions 33 and 33' and the second tongue portions 34 and 34' near the side surface edge portions 67 and 67' and 68 and 68' of the insulation housing 40, respectively.

Further, the tapers 63 and 63' and 64 and 64' are utilized to install the first tongue portions 33 and 33' and the second tongue portions 34 and 34' more securely and deeper inside of the insulation housing 40, respectively.

In the embodiment, solder portions 36 and 36' and the board 70 are provided on right and left sides of the shell 20 in a conventional manner. The connector 1 is fixed to the board 70 with solder. Further, the solder portions 56 of the terminals 50 are fixed to the board 70 with solder.

In addition, parts of the second tongue portion 34 (38 and 38') provided on the bottom plate portion 25 side can be fixed to the board with solder. That is, the parts of the second tongue portions 34 and 34' that are caulked can form board connection portions 38 and 38' for the board 70. Accordingly, the parts of the second tongue portions 34 and 34' (38 and 38') are connected (mounted) to the board 70 so that the second tongue portions 34 and 34' are securely fixed to the board 70.

Consequently, even though an excessive external force such as twisting force is applied, the force is dispersed over the whole connector 1 and the insulation housing 40 can be prevented from coming off from the shell 20.

Further, the shell 20 that has a shielding function can be connected to the board 70 so that the connector 1 has better shielding property. In addition, the board connection portions 38 and 38' are provided to hold the solder portions 56 of the terminals 50 therebetween to improve the signal performance.

When the mating connector is inserted into or removed from the connector 1, a large force may be applied in a fitting direction to the inward protruding portions 29 and 29', the first tongue portions 33 and 33', or the second tongue portions 34 and 34'.

In the embodiment, the inward protruding portions 29 and 29', the first tongue portions 33 and 33', or the second tongue portions 34 and 34' receive the force in the fitting direction in the fracture planes (for example, between the side surface edge portions 68 and 68' of the first tongue portions 33 and 33', or the contact surfaces 37 and 37' of the inward protruding portions 29 and 29', respectively) or in other words, width portions arranged along the fitting direction of the mating connector.

Accordingly, the large force can be generated against such a force. Therefore, the shell 20 can hold the insulation housing 40 more securely; thereby a solder crack or the like can be effectively prevented between the solder portion and the board. The solder crack can be occurred when the mating connector is inserted or removed.

The electrical connector is explained above as an example of the present invention. The present invention is not limited to the electrical connector but can be applied to various types of connectors. Further, in the above embodiment, a position in which the housing cover is caulked to the housing is the most rear portion of the housing in a fitting direction of the mating connector.

Figure 10:
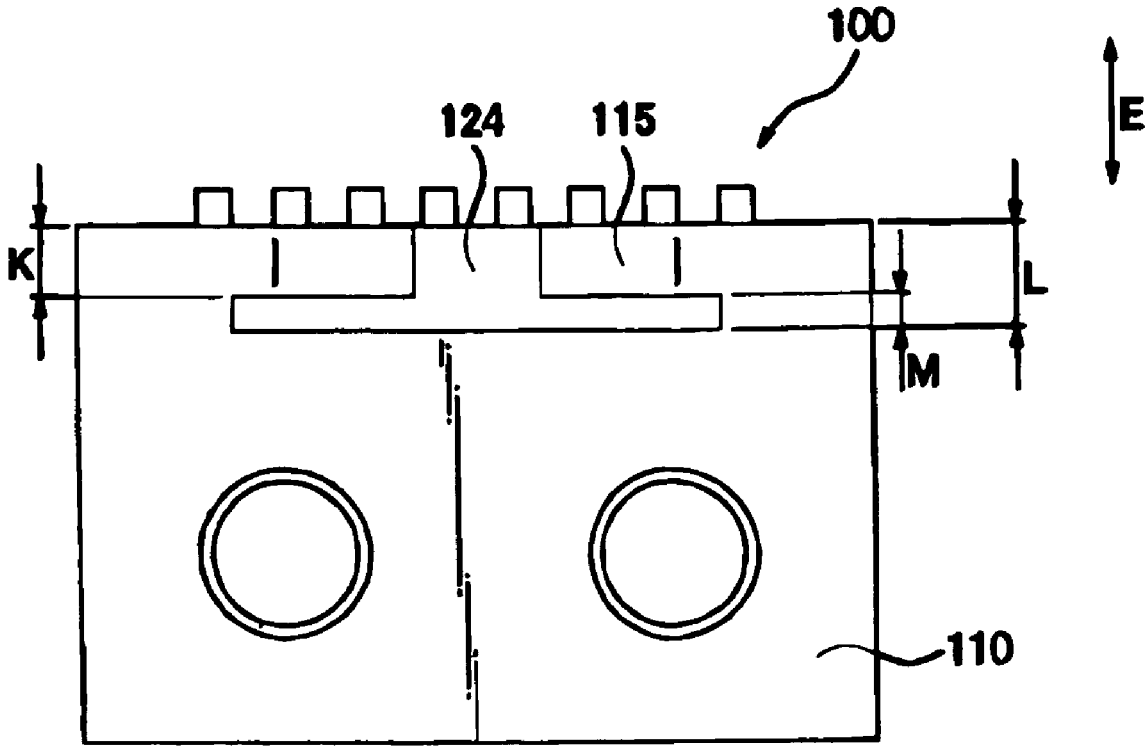
FIG. 10 PRIOR ART
FIG. 10 is a plan view showing a conventional connector.
Figure 11:
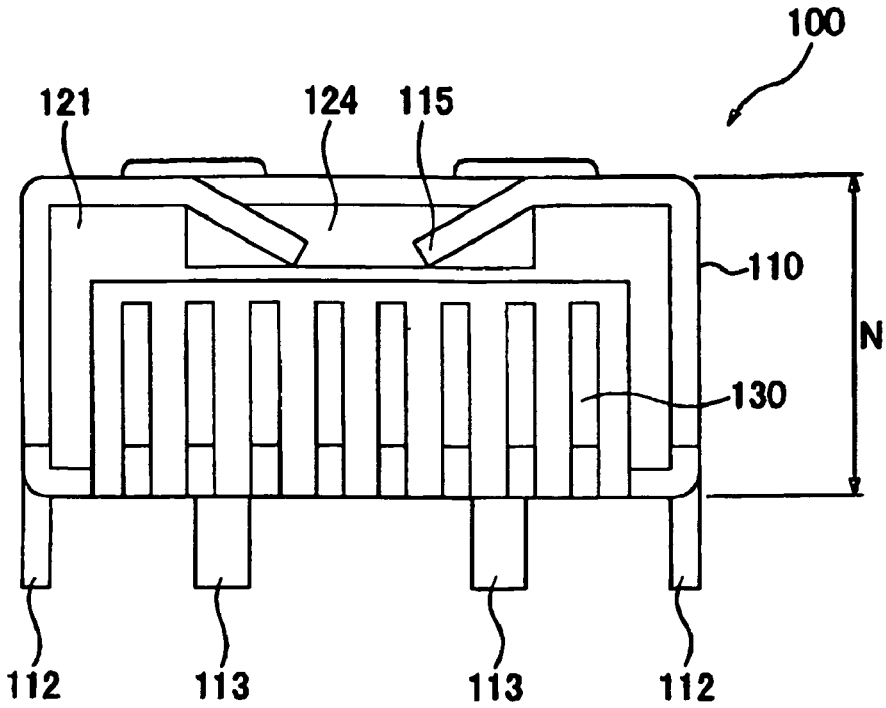
FIG. 11 PRIOR ART
FIG. 11 is a bottom view showing the conventional connector.
Figure 12:
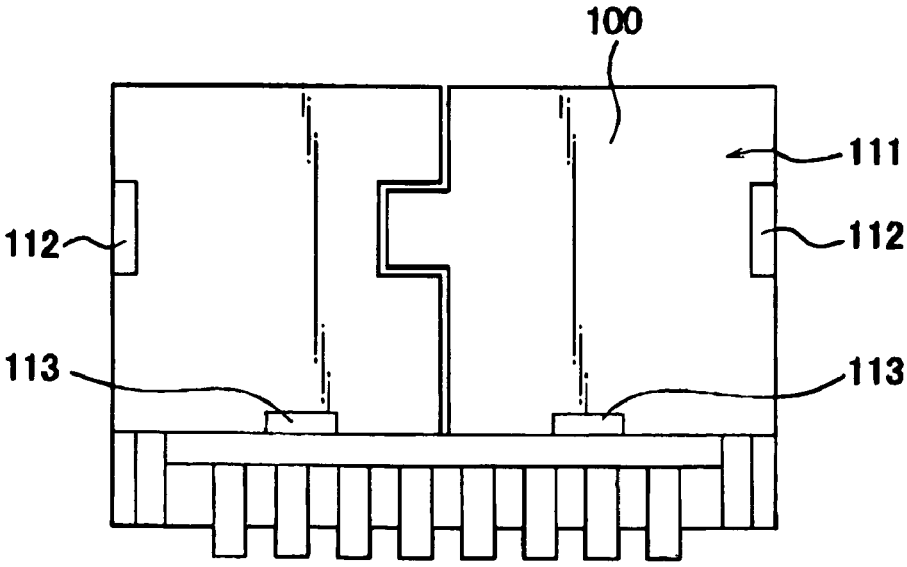
FIG. 12 PRIOR ART
FIG. 12 is a rear view showing the conventional connector.

Further, as the prior art shown in FIGS. 10 to 12, the position in which the housing cover is caulked to the housing can be the middle position of the housing in a fitting direction. In this case, the tongue portions are provided in the middle position of the housing cover in a fitting direction. Further, the housing is provided with a recess portion as shown in the prior art of FIG. 10, for example, for such tongue portions can be inserted.

The disclosure of Japanese Patent Application No. 2007-084652, filed on Mar. 28, 2007, is incorporated in the application by reference.

While the invention has been explained with reference to the specific embodiments of the invention, the explanation is illustrative and the invention is limited only by the appended claims.

What is claimed is:

1. A connector to be fitted to a mating connector in a first direction, comprising:

a shell including a first opening portion for inserting the mating connector and a second opening portion, said shell further including a first tongue portion and a second tongue portion both extending in a second direction perpendicular to the first direction, said second tongue portion including a board connection portion to be connected to a board;

a housing disposed in the shell, said housing including a housing main body for closing the second opening portion, a holding portion extending from the housing main body toward the first opening portion, and a protruding portion extending from a backside of the housing main body toward the second opening portion, said protruding portion being arranged so that the first tongue portion and the second tongue portion cover the protruding portion from an upper side and a lower side of the protruding portion; and a terminal disposed in the housing.

2. The connector according to claim 1, wherein said first tongue portion has a width in the first direction smaller than that of the second tongue portion.

3. The connector according to claim 1, wherein said shell further includes an inner protruding portion protruding from an upper surface thereof toward inside the shell, said inner protruding portion and said first tongue portion being arranged to sandwich the housing.

4. The connector according to claim 1, wherein said housing further includes a tapered portion contacting with the first tongue portion and the second tongue portion.

5. The connector according to claim 3, wherein said inner protruding portion extends in a third direction perpendicular to the first direction, said inner protruding portion including a first sectional surface, said first tongue portion including a second sectional surface so that the housing is sandwiched between the first sectional surface and the second sectional surface.

6. The connector according to claim 3, wherein said inner protruding portion includes an abutting portion on a side of the first opening portion for abutting against a distal end portion of the mating connector.

* * * * *